US005244238A

United States Patent [19]

Lindqvist

[11] Patent Number: 5,244,238

[45] Date of Patent: Sep. 14, 1993

[54] LOCKING MECHANISM FOR SASH TYPE WINDOWS

[75] Inventor: Per O. Lindqvist, Onsala, Sweden

[73] Assignee: Fix-Abloy AB, Sweden

[21] Appl. No.: 995,590

[22] Filed: Dec. 22, 1992

[51] Int. Cl.[5] ..... E05C 9/00

[52] U.S. Cl. ..... 292/7; 49/174; 49/176; 292/36; 292/DIG. 47; 292/DIG. 62

[58] Field of Search ..... 292/66, 175, 7, 8, 111, 292/DIG. 47, DIG. 62, 36; 49/174, 176

[56] References Cited

U.S. PATENT DOCUMENTS

| | | | |
|---|---|---|---|
| 2,322,040 | 6/1943 | Moruri | 292/166 X |
| 4,475,311 | 10/1984 | Gibson | 49/176 |
| 4,643,005 | 2/1987 | Logas | 292/8 X |
| 5,090,750 | 2/1992 | Lindqvist | 292/7 |
| 5,143,412 | 9/1992 | Lindqvist | 292/DIG. 47 X |

*Primary Examiner*—Richard E. Moore

*Attorney, Agent, or Firm*—Lerner, David, Littenberg, Krumholz & Mentlik

[57] ABSTRACT

A locking mechanism for windows having upper and lower sashes slidably disposed in a window frame. The mechanism has three modes, that is a locked mode, an unlocked mode and an auxiliary mode. In the locked mode at least one sash clamp mounted on a transverse rail of one sash engages a cooperating receiving element mounted to the adjacent transverse rail of the other sash, whilst a spring-biased pawl projects into a guide groove in the window frame. In the unlocked mode the sash clamp disengages the receiving element to allow the sashes to be slid relative to each other. In the auxiliary mode the spring-biased pawl is withdrawn from the guide groove to permit the sash to be moved transversely for cleaning.

11 Claims, 5 Drawing Sheets

LOCKING MECHANISM FOR SASH TYPE WINDOWS

FIELD OF THE INVENTION

The present invention relates to a locking mechanism for application on a sash type window having upper and lower sliding sashes slidably disposed in a window frame, each sash being enclosed by a frame composed of side rails and transverse rails, top and bottom transverse rails of the lower and upper sashes respectively forming a meeting rail of the respective sash which, when the sashes are in the closed position, abuts the adjacent rail of the other sash, said locking mechanism being mounted to the top transverse rail of the lower sash and being operable by a handle.

BACKGROUND OF THE INVENTION

Historically, sash type windows have displayed two major disadvantages, the first being the difficulty in obtaining a satisfactory seal between adjacent sash rails and the second being the difficulty in gaining access to the outer facing surface of the lower sash to facilitate its cleaning. A partial solution to these problems is disclosed in U.S. Pat. No. 5,090,750. In said patent a locking mechanism mounted on the transverse rail of one sash comprises a pair of sash clamps which can be brought into engagement and disengagement with corresponding receiving elements on the adjacent rail of the other sash. In addition, locking bolts mounted on the transverse rail of one sash can be brought into engagement with a sidewall of a guide groove in the window frame. By the provision of a complex series of linkages, a single handle can control the relative positioning of the sash clamps and the locking bolts between three distinct positions, i.e. a locked position in which the sash clamps engage the receiving elements and the locking bolts engage the sidewall of the guide groove, an unlocked position in which the sash clamps and the locking bolts are disengaged from the receiving elements and the sidewall respectively, and a release position in which the locking bolts are retracted from the groove to thereby allow the lower sash to be swung away from the window frame.

Whilst the above-described arrangement offers certain advantages over prior locking mechanisms, its complex series of linkages requires that the operating handle be both rotatably and vertically displaceable to effect the required operating sequence.

SUMMARY OF THE INVENTION

It is therefore an object of the present invention to provide a locking mechanism for sash type windows which overcomes the above-mentioned disadvantages.

This object is attained by a locking mechanism for a window having a window frame including a guide groove extending in movement directions, and having upper and lower sashes at least one of which is slidable with respect to said frame in said movement directions, each of said sashes having a meeting rail, said meeting rails adapted to lie adjacent one another when said sashes are in a closed position, said locking mechanism comprising i) at least one sash clamp connected to one of said meeting rails, ii) at least one receiving element corresponding to said at least one sash clamp connected to the other of said meeting rails, iii) a pawl disposed at an end of said one of said meeting rails and adapted in an extended position to lie within said guide groove, iv) a handle movable between a locked position, an unlocked position and an auxiliary position, and v) an operating mechanism including an actuator rod responsive to movement of said handle and upon which rod said at least one sash clamp is pivotally carried such that when said handle is in said locked position said at least one sash clamp engages said at least one receiving element, and when said handle is in said unlocked position said at least one sash clamp disengages said at least one receiving element;

wherein said pawl is spring-biased to said extended position, and said pawl and said actuator rod are provided with cooperation means such that when said handle is moved from said unlocked position to said auxiliary position said actuator rod effects retraction of said pawl from within said guide groove.

Further embodiments of the present invention are detailed in the dependent claims.

Further scope of applicability of the present invention will become apparent from the detailed description given hereinafter. However, it should be understood that the detailed description and specific examples, while indicating preferred embodiments of the invention, are given by way of example only, since various changes and modifications within the spirit and scope of the invention will become apparent to those skilled in the art from this detailed description.

DETAILED DESCRIPTION OF A PREFERRED EMBODIMENT

Figure 1:
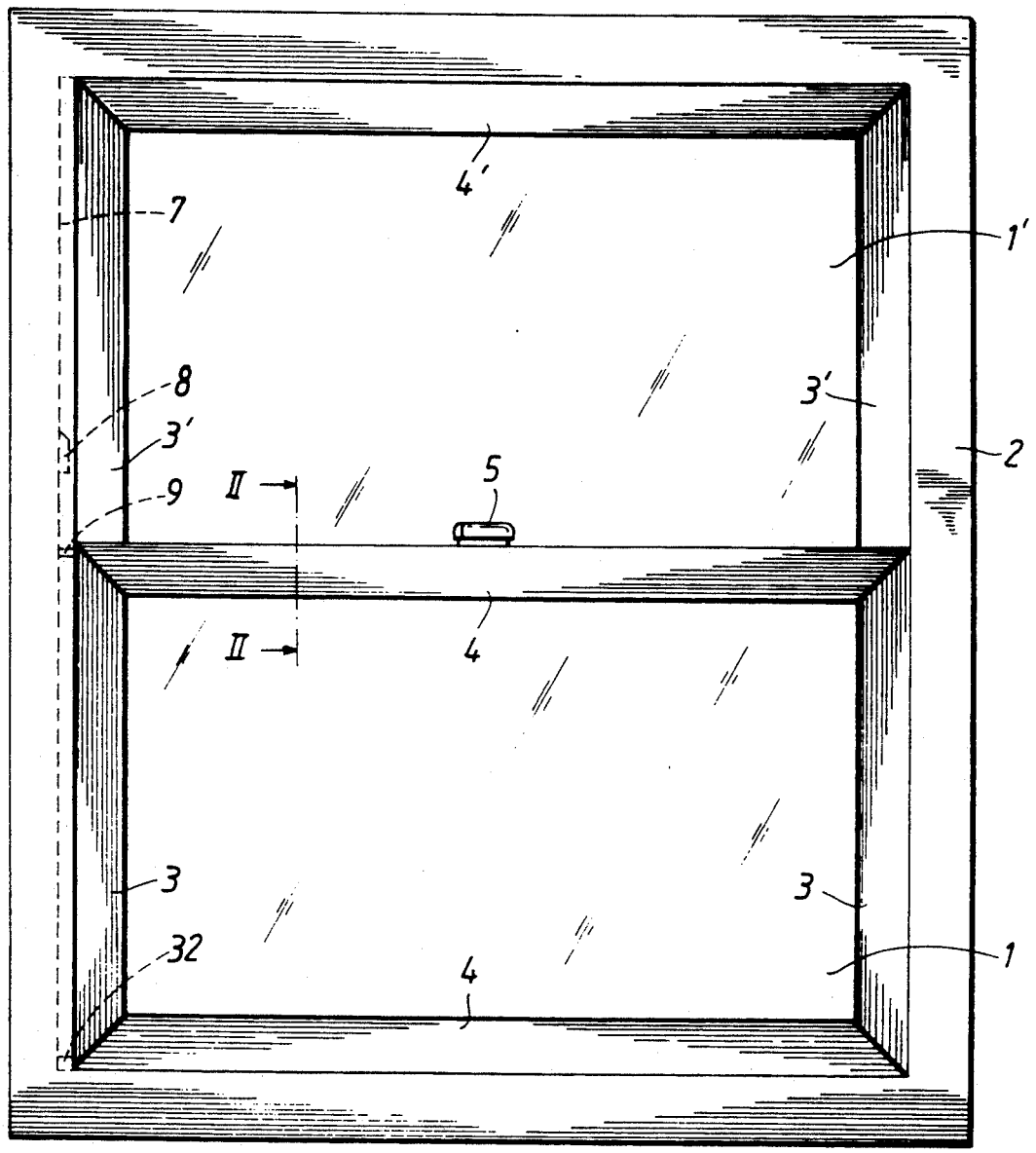
FIG. 1 is a schematic perspective view of a sash window assembly provided with a locking mechanism according to the present invention.
Figure 2:
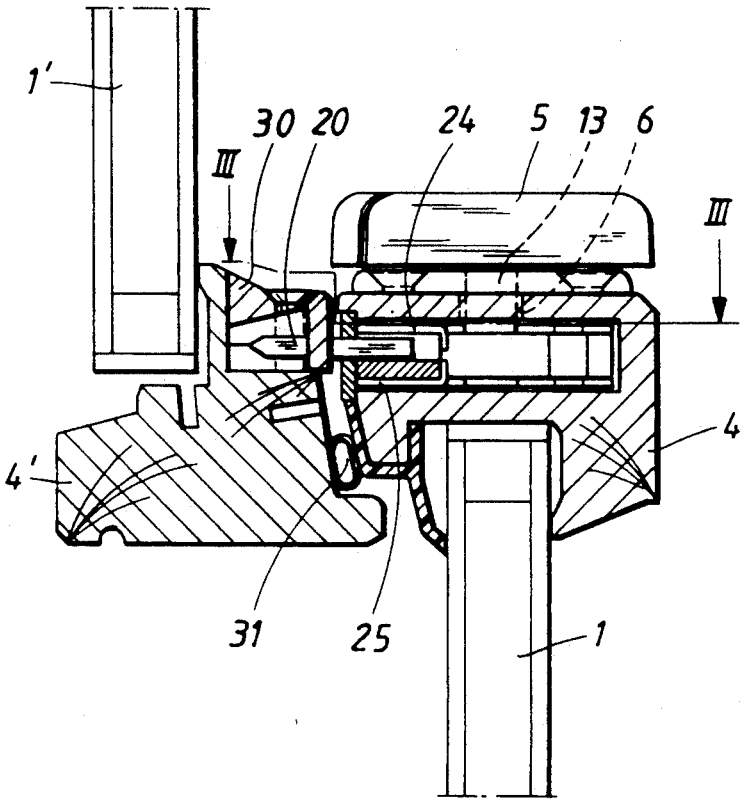
FIG. 2 is a sectional view along line II—II of FIGS. 1 and 3.

Referring to FIG. 1, the lower and upper sliding sashes of a window assembly are indicated by the reference numerals 1 and 1' respectively The sashes 1, 1' are constrained to move in sliding directions within a window frame 2. Each sash is enclosed by a frame composed of side rails 3, 3' and transverse rails 4, 4', the top and bottom transverse rails of the lower and upper sashes respectively forming the meeting rail of the respective sash which, when the sashes are in the closed position, abuts the adjacent rail on the other sash, as best seen in FIG. 2.

The locking mechanism according to the present invention is incorporated in the upper transverse rail 4 of the lower sash 2. The mechanism is operated by a handle 5 projecting through a hole 6 in the transverse rail 4. Since virtually all of the mechanism, with the exception of the handle 5, is located within the upper transverse rail 4, the locking mechanism barely detracts from the appearance of the window assembly. The handle 5 is arranged to be movable between a locked position, an unlocked position and an auxiliary position. In the drawings the handle 5 is shown centrally mounted on the mechanism, with the mechanism being symmetric about the center line of the handle. For reasons of simplicity, only one half of the mechanism is shown in the remaining drawings. However, it is to be understood that the handle need not to be centrally mounted but may be offset if circumstances so dictate.

As indicated in FIG. 1 by dashed lines, the window frame 2 presents at least one guide groove 7 extending in movement directions of the lower sliding sash in order to restrict the extent to which the lower sash 1 may be slid upwards, a blocking piece 8 may be inserted in the groove 7. The blocking piece 8 is adapted to cooperate with a pawl 9 on the locking mechanism in a manner which will be apparent from the following.

Figure 3:
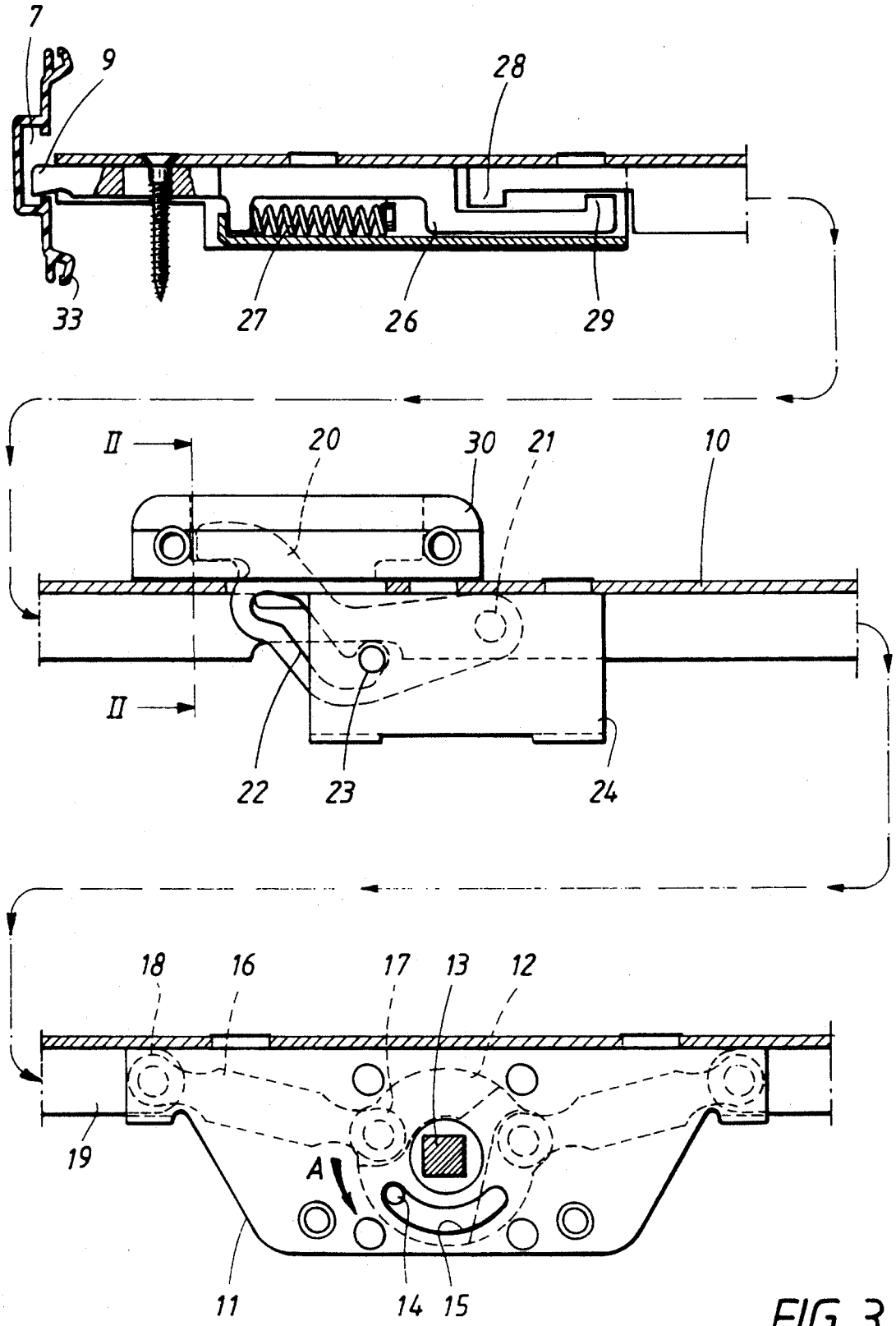
FIG. 3 is a plan view of the locking mechanism removed from the sash rail and in its locked mode.
Figure 4:
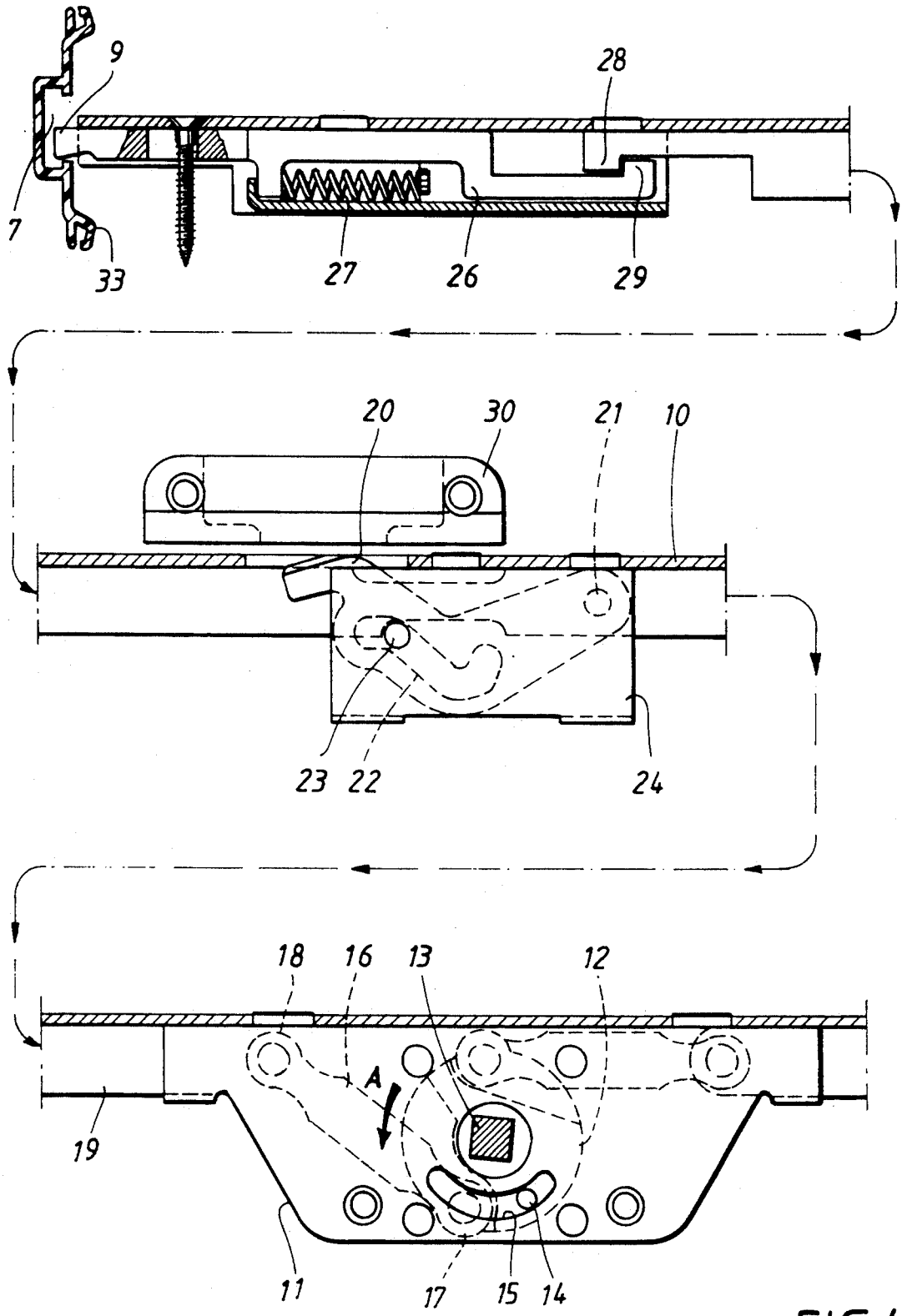
FIG. 4 is a plan view similar to FIG. 3, but with the locking mechanism in its open mode.
Figure 5:
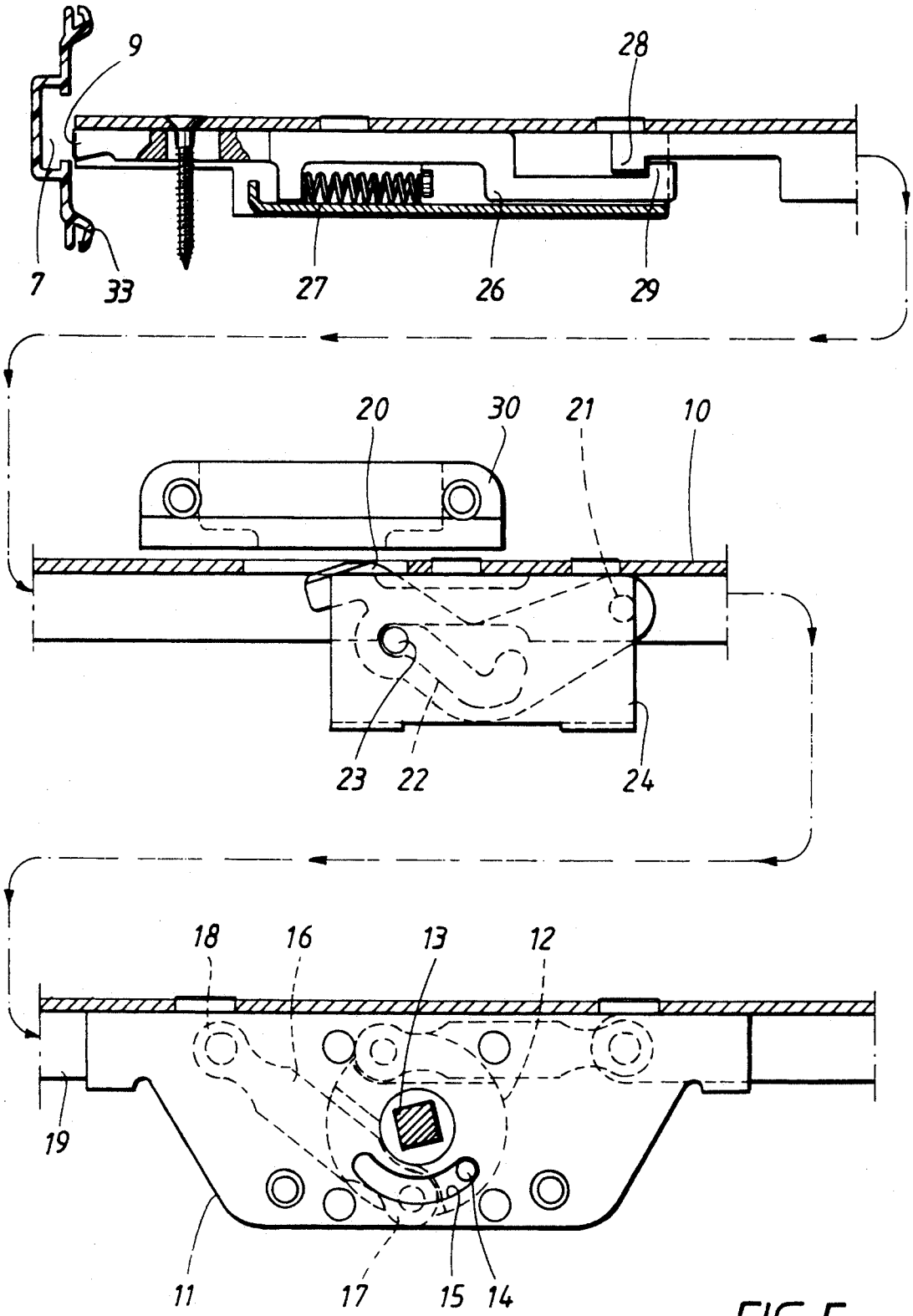
FIG. 5 is a plan view of the locking mechanism in its third mode.

A portion of the locking mechanism is shown in FIGS. 3, 4 and 5. The locking mechanism comprises a front plate 10 which determines the relative positions of components making up the mechanism. A handle housing 11 is affixed to the front plate 10 and incorporates a disk 12 which is arranged to be rotated by a spindle 13 extending from the handle 5 (see FIG. 2). A peg 14 carried on the disk 12 projects into an arcuate slot 15 of predetermined length on the housing 11, the length of the slot 15 determining the degree to which the handle can be rotated. A link arm 16 has one end 17 pivotally attached to the disk 12 and its other end 18 pivotally attached to one end of an actuator rod 19. The actuator rod extends substantially parallel to the front plate 10 and is constrained to slide parallel thereto. Thus, rotational movement of the disk 12 is converted into linear displacement of the actuator rod 19.

The locking mechanism further comprises two sash clamps 20, one on either side of the handle housing 11. Since the locking mechanism is symmetric about the handle arrangement, only the left-hand half of the mechanism as shown in the drawings will be described. Seen from above, the sash clamp 20 is dog-leg shaped and is arranged to be pivotable about a pivot pin 21 carried on the actuator rod 19. Accordingly, displacement of the actuator rod 19 effects displacement the sash clamp 20. The actual displacement of the sash clamp 20 is determined by a shaped slot 22 in the sash clamp, through which a stationary peg 23 passes. The peg 23 is fixedly located between a pair of support plates 24, 25 (see also FIG. 2) which are in turn fixedly attached to the front plate 10 of the locking mechanism.

The actuator rod 19 extends past the sash clamp 20 and terminates at a location at which it can cooperate with the pawl 9. The pawl 9 constitutes the outer end of a pawl actuator member 26. The pawl actuator member 26 is slidably arranged parallel to the front plate 10 and is acted upon by a resilient element, preferably in the form of a helical spring 27, to bias the actuator member to the left as shown in the drawings so that in its normal position the pawl 9 projects into the groove 7 in the window frame 2. For reasons of clarity the window frame 2 is not shown in FIGS. 3 to 5.

The actuator rod 19 and the pawl actuator member 26 are provided with cooperation means to effect retraction of the pawl 9. The cooperation means comprises an engagement portion 28 on the actuator rod 19 and a corresponding receiving portion 29 on the pawl actuator member 26. As will be explained in more detail below, the cooperation means are arranged such that the engagement portion 28 engages the receiving portion 26 only when the handle is moved from its unlocked position to its auxiliary position and back to its unlocked position.

In the locked position shown in FIG. 3, the sash clamp 20 firmly engages a receiving element 30 mounted to the lower transverse rail 4' (not shown in FIGS. 3 to 5) of the upper sash 1'. Contacting surfaces of the sash clamp and receiving element are so shaped that, upon engagement of the sash clamp with the receiving element, the upper transverse rail of the lower window sash is drawn towards the adjacent rail of the other sash, thereby compressing a rubber seal 31 disposed between the meeting rails (FIG. 2). In addition, upper contacting surfaces of the sash clamp and respective surfaces of the receiving element are so shaped that, upon engagement of the sash clamp with the receiving element, the upper sash is slightly vertically displaced with respect to the lower sash. In this manner improved sealing is obtained, both between the sashes and between the window frame and the sashes.

Operation of the locking mechanism between the locked position, unlocked position and auxiliary position will now be described with particular reference to FIGS. 3 to 5.

If it be desired to release the locking mechanism from the position shown in FIG. 3 so that the lower sash can be displaced with respect to the upper sash, the handle 5 is rotated to effect rotation of the disk 12 within the handle housing in a direction indicated by the arrow A. Rotation of the disk 12 causes the link arm 16 to draw the actuator rod 19 to the right as shown in the drawings, thereby causing the pivot pin 21 to be displaced to the right. Due to the relative movement of the sash clamp 20 with respect to the peg 23 passing through the slot 22 in the sash clamp, the sash clamp is caused to be withdrawn from the receiving element 30 and is retracted into the upper transverse rail 4 of the lower sash 1.

During the above-described unlocking operation, the engagement portion 28 on the actuator rod 28 approaches the receiving portion 29 of the pawl actuator member. The amount of "free play" between the engagement portion 28 and the receiving portion 29 is chosen such that when the sash clamp 20 is fully retracted into the transverse rail 4, the engagement portion and the receiving portion abut. Due to the spring-biasing of the pawl actuator member 26, when the engagement portion and the receiving portion come into abutting contact increased resistance to the turning of the handle 5 can be felt be a person operating the locking mechanism. This increase in resistance indicates to the person that the mechanism has reached its unlocked position as shown in FIG. 4 and that the lower sash 1 can now be slidably displaced with respect to the upper sash 1'.

With reference to FIG. 1, it is often advantageous if the extent to which the lower sash can be opened can be restricted. In accordance with the present invention this can be achieved by affixing a blocking piece 8 in the groove 7. Thus, during its upwardly sliding movement, the fact that the pawl 9 projects from the upper transverse rail 4 means that the lower sash is prevented from sliding past the blocking piece 8. Under certain circumstances it is desirable that the lower sash can be fully opened, e.g. when the outer surface of the upper sash 1' is to be cleaned. To accommodate this requirement, the locking mechanism according to the present invention is provided with a third mode.

With particular reference to FIG. 5, in order to effect retraction of the pawl 9 from the groove 7, the handle 5 is rotated further in the direction of arrow A (FIG. 3) to its auxiliary position. This additional rotation causes the actuator rod 19 to move further to the right, thereby causing its engagement portion 28 to displace the receiving portion 29 of the pawl actuator member 26 substantially an equal distance to the right against the action of the spring 27. In its auxiliary position, the mechanism adopts the position shown in FIG. 5 with the peg 14 on the disk 12 abutting the end of the slot 15 in the handle housing 11 and the pawl 9 withdrawn from the groove 7. Due to the shaping of the slot 22 in the sash clamp 20, although the sash clamp is also displaced during the movement of the actuator rod 19, it still remains within the rail 4.

With the locking mechanism in the auxiliary position, the lower sash 1 can be slid past the blocking element 8. Thereafter, the handle 5 can be released and the action of the spring 27 will cause the locking mechanism to adopt the position shown in FIG. 4, i.e. the unlocked position.

By providing the blocking element 8 with a sloping upper surface, the upper surface can act as a cam surface when the lower sash is to be slid back to its closed position, thereby obviating the need to manually rotate the handle 5 to the auxiliary position. This can also be achieved by providing the pawl 9 with a sloping lower surface instead.

In order to facilitate e.g. the cleaning of the outer surface of the lower sash 1, means are provided to allow the lower sash 1 to be pivoted away from the upper sash 1' to thereby open inwardly. With reference to FIG. 1, this is achieved by providing the lower sash 1 at its lowermost region with a pair of fixed pivot pins 32, each pin extending into the groove 7 on either side of the window frame 2. As shown in FIGS. 3 to 5, the groove 7 may be provided with a plastic lining 33 which is resiliently affixed to the window frame 2. Accordingly, and with particular reference to FIGS. 1 and 5, when the locking mechanism is in its auxiliary mode with the pawl 9 withdrawn from the groove 7, the upper transverse rail 4 of the lower sash can be pulled away from the lower transverse rail 4' of the upper sash 1' so that the pawl-bearing end of the transverse rail 4 moves out of alignment with the groove 7 and displaces the plastic lining 33 to the left as shown in FIG. 5 to thereby allow the lower sash to pivot about the pins 32. The lower sash 1 is returned to its vertical position by maintaining the operating handle 5 in its auxiliary position as the lower sash 1 is pivoted about the pins 32 towards the lower transverse rail 4' of the upper sash 1' until the pawl-bearing end of the transverse rail 4 has moved into the region of the window frame 2 covered by the plastic lining 33.

It is to be understood the present invention is not restricted to the above-described embodiment, but may be varied within the scope of the appended claims. For example, the sash clamps may be more or less than two in number. Similarly, pairs of sash clamps may be provided with one sash clamp arranged above the other, with the surfaces of the clamps facing away from each other cooperating with surfaces of a receiving element to effectively double the clamping force between the two sashes.

What is claimed is:

1. A locking mechanism for a window having a window frame including a guide groove extending in movement directions, and having upper and lower sashes at least one of which is slidable with respect to said frame in said movement directions, each of said sashes having a meeting rail, said meeting rails adapted to lie adjacent one another when said sashes are in a closed position, said locking mechanism comprising i) at least one sash clamp connected to one of said meeting rails, ii) at least one receiving element corresponding to said at least one sash clamp connected to the other of said meeting rails, iii) a pawl disposed at an end of said one of said meeting rails and adapted in an extended position to lie within said guide groove, iv) a handle movable between a locked position, an unlocked position and an auxiliary position, and v) an operating mechanism including an actuator rod responsive to movement of said handle and upon which rod said at least one sash clamp is pivotally carried such that when said handle is in said locked position said at least one sash clamp engages said at least one receiving element, and when said handle is in said unlocked position said at least one sash clamp disengages said at least one receiving element;

wherein said pawl is spring-biased to said extended position, and said pawl and said actuator rod are provided with cooperation means such that when said handle is moved from said unlocked position to said auxiliary position said actuator rod effects retraction of said pawl from within said guide groove.

2. The locking mechanism as claimed in claim 1, wherein said cooperation means comprises an engagement portion on said actuator rod and a corresponding receiving portion on said pawl, said engagement portion engaging said receiving portion only when said handle is moved from said unlocked position to said auxiliary position and back to said unlocked position.

3. The locking mechanism as claimed in claim 2, wherein said pawl is spring-biased to said extended position in such a manner that upon release of the handle from the auxiliary position the locking mechanism will adopt said unlocked position.

4. The locking mechanism as claimed in claim 1 or 3, wherein said handle is rotated between said locked, unlocked and auxiliary positions in a single plane.

5. The locking mechanism as claimed in claim 3, wherein blocking means are provided in the guide groove in the window frame to prevent the lower sash from being raised past said blocking means unless said handle is in said auxiliary position.

6. The locking mechanism as claimed in claim 3, wherein said blocking means allow said lower sash to be lowered from a raised position past said blocking means with said handle in said unlocked position.

7. The locking mechanism as claimed in claim 4, wherein means are provided to allow the lower sash to be pivoted away from the upper sash.

8. The locking mechanism as claimed in claim 7, wherein said means include a pair of fixed pivot pins provided on the lower sash, said pivot pins projecting into the guide groove in the window frame.

9. The locking mechanism as claimed in claim 8, wherein the guide groove is provided with a resiliently mounted plastic lining.

10. The locking mechanism as claimed in any one of claims 1, 2, 3, 5 or 6, wherein contacting surfaces of the sash clamp and its corresponding receiving element are so shaped that, upon engagement of the sash clamp with the receiving element, the upper transverse rail of the lower window sash is drawn towards the adjacent rail of the other sash.

11. The locking mechanism according to claim 10, wherein further contacting surfaces of the sash clamp and its corresponding receiving element are so shaped that, upon engagement of the sash clamp with the receiving element, the upper sash is vertically upwardly displaced with respect to the lower sash.

* * * * *